US005588156A

United States Patent [19]

Panton, Jr.

[11] Patent Number: 5,588,156

[45] Date of Patent: Dec. 31, 1996

[54] ARTICLE OF CLOTHING HAVING HIGH VISIBILITY

[75] Inventor: George S. Panton, Jr., Melbourne Beach, Fla.

[73] Assignee: Diamond Safety Gear, Inc., Indialantic, Fla.

[21] Appl. No.: 470,584

[22] Filed: Jun. 7, 1995

[51] Int. Cl.[6] ..... A41D 13/00; A41D 27/08

[52] U.S. Cl. ..... 2/243.1; 2/115; 2/238; 2/244; 40/586

[58] Field of Search ..... 2/69, 1, 425, 410, 2/79, 94, 102, 115, 227, 238, 243.1, 244, 246, 905, 108; 40/329, 586, 582, 583, 903; 359/518, 519

[56] References Cited

U.S. PATENT DOCUMENTS

| | | | |
|---|---|---|---|
| Re. 29,742 | 8/1978 | Tung | 2/412 |
| 2,457,309 | 12/1948 | Joyce | 2/244 |
| 3,577,561 | 5/1971 | Csss | 2/209.13 |
| 3,738,299 | 6/1973 | Packler et al. | 2/246 |
| 3,963,307 | 6/1976 | Kirk | 40/125 H |
| 4,211,261 | 7/1980 | Mehta et al. | 2/2 |
| 4,365,354 | 12/1982 | Sullivan | 2/247 |
| 4,397,142 | 8/1983 | Bingham | 2/243.1 |
| 4,817,210 | 4/1989 | Aldridge et al. | 2/81 |
| 4,999,938 | 3/1991 | Behling | 40/610 |
| 5,110,655 | 5/1992 | Engler et al. | 2/5 |
| 5,283,101 | 2/1994 | Li | 2/5 |

*Primary Examiner*—Amy B. Vanatta
*Attorney, Agent, or Firm*—Ronald P. Kananen

[57] ABSTRACT

An article of clothing comprising a diamond-shaped retroreflective material, which diamond-shaped retroreflective material encloses a first colored accent area and which diamond-shaped retroreflective material is enclosed, in whole or in part, by a second colored accent area is described.

19 Claims, 4 Drawing Sheets

ARTICLE OF CLOTHING HAVING HIGH VISIBILITY

BACKGROUND OF THE INVENTION

1. Field of the Invention

The present invention pertains to an article of clothing having enhanced visibility. More particularly, this invention relates to an article of activewear clothing having enhanced visibility. Still more particularly, this invention relates to an article of clothing, which article is worn for activities in which there is substantial risk of proximity to vehicles and which article has enhanced visibility. These activities include cycling, walking, jogging, running, and in-line skating.

2. Discussion of the Background

With the growing awareness of the importance of exercise in achieving and maintaining health and well-being, increasing numbers of people are exercising outdoors at various times of the day and night. Unfortunately, such exercise regimens place these fitness enthusiasts at risk. Frequently people exercising are forced to share the road or exercise area with vehicles whose speed and mass pose significant risks in the event of an accident. Moreover, the risk of accident increases with decreasing visibility conditions, such as occurs at night, dusk, dawn, or overcast conditions, for example.

High-visibility materials for personal safety are widespread, for example, the brightly colored neon (fluorescent) and retroreflective trims and designs found on garments and accessories, such as running shoes, childrens' backpacks, mail carriers' jackets, firefighters' protective gear and highway workers' safety vests. Such materials offer an increased opportunity for the wearer to be seen. However, such trims and designs do not conspicuously provide the 360° visibility necessary to reduce the risk of accidents to a minimum. Moreover, the conventional designs and trims do not evoke a response of caution from an operator of a motor vehicle nor do these designs and trim conspicuously emphasize the human form. Thus, there remains a need for an article of clothing which reduces the risk of accidents by enhancing the visibility of the person wearing the article, provides 360° visibility, evokes a response of caution from an operator of a motor vehicle, and emphasizes the human form.

SUMMARY OF THE INVENTION

Accordingly, an object of the present invention is to provide a novel article of clothing which enhances the visibility of the person wearing the article.

It is another object of the present invention to provide an article of activewear clothing which enhances the visibility of the person wearing the article.

These and other objects have been achieved by means of an article of clothing to which is affixed one or more pieces of diamond-shaped retroreflective material, which diamond-shaped retroreflective material, either may be solid or may enclose a first colored accent area and which diamond-shaped retroreflective material is enclosed, in whole or in part, by a second colored accent area and a contrasting border.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein.

DETAILED DESCRIPTION OF THE PREFERRED EMBODIMENTS

Figure 1:
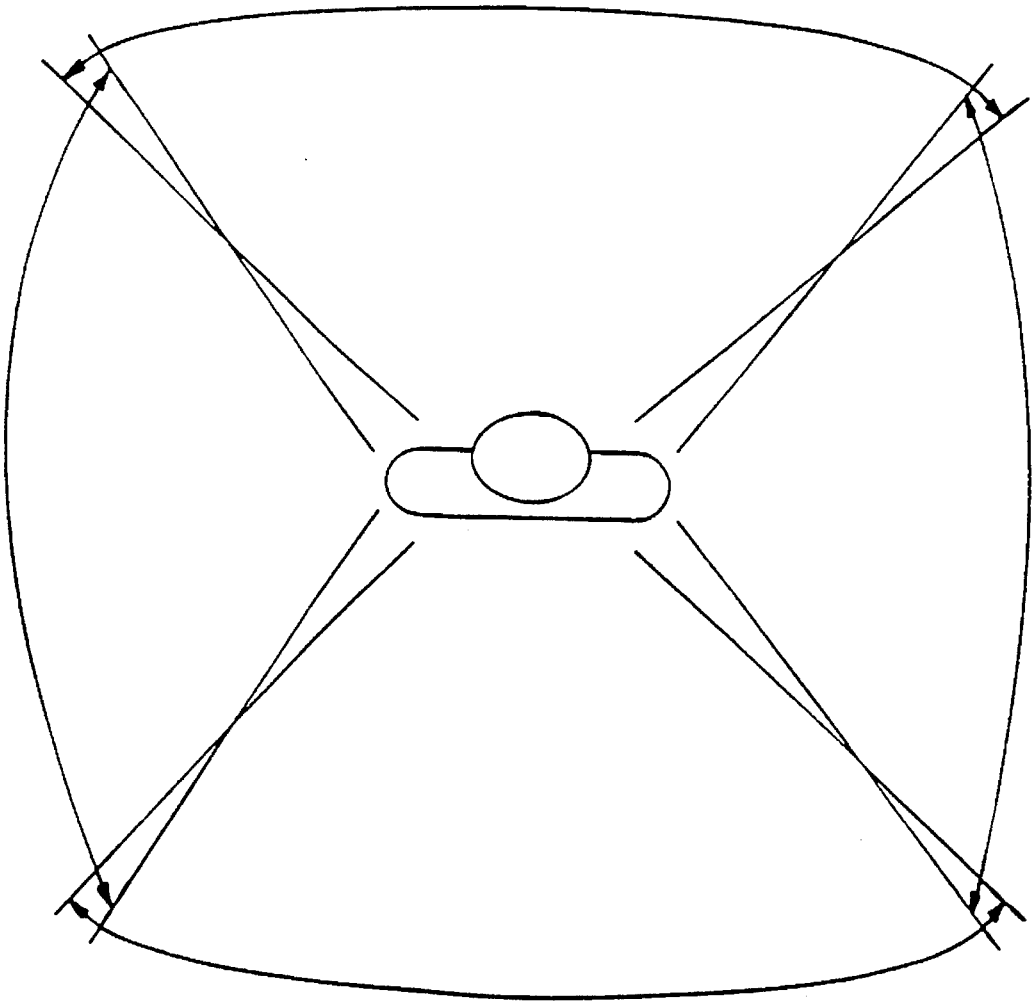
FIG. 1 is a top view depicting the visibility of a person wearing an article of clothing corresponding to the present invention.
Figure 2:
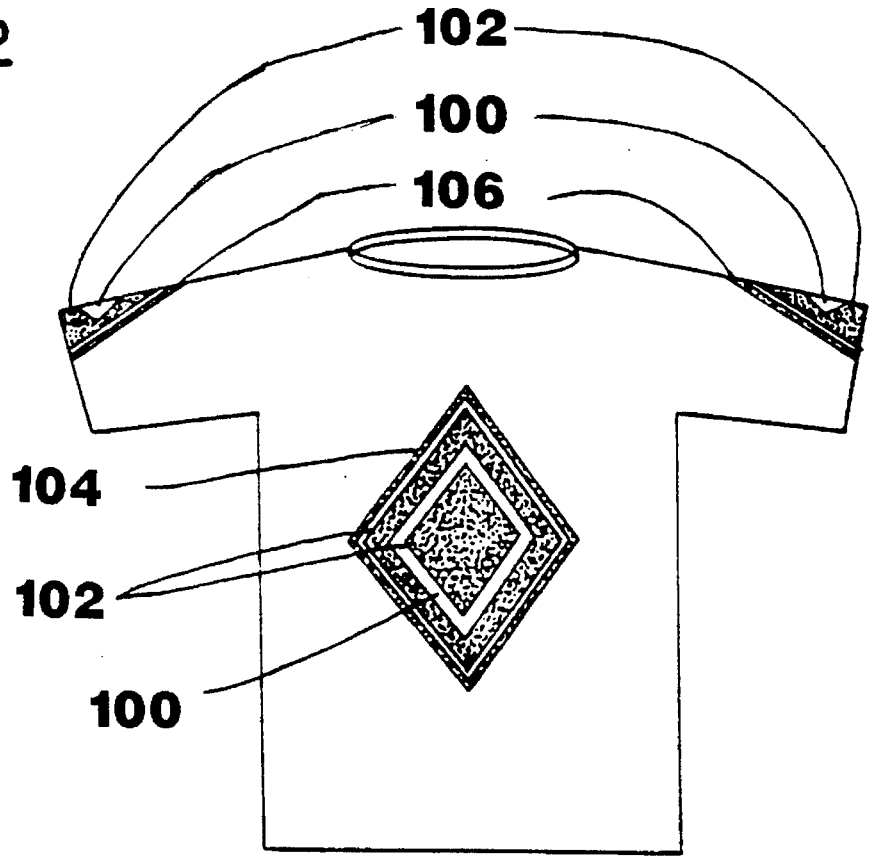
FIG. 2 depicts a front view of a cotton T-shirt.
Figure 3:
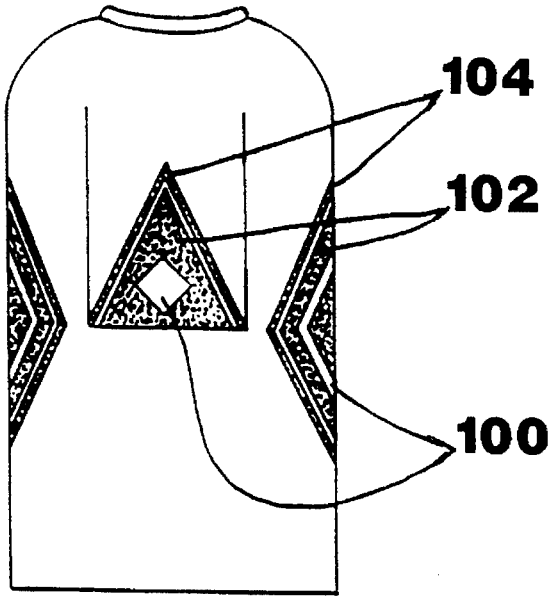
FIG. 3 illustrates a side view of the cotton T-shirt of FIG. 2.
Figure 4:
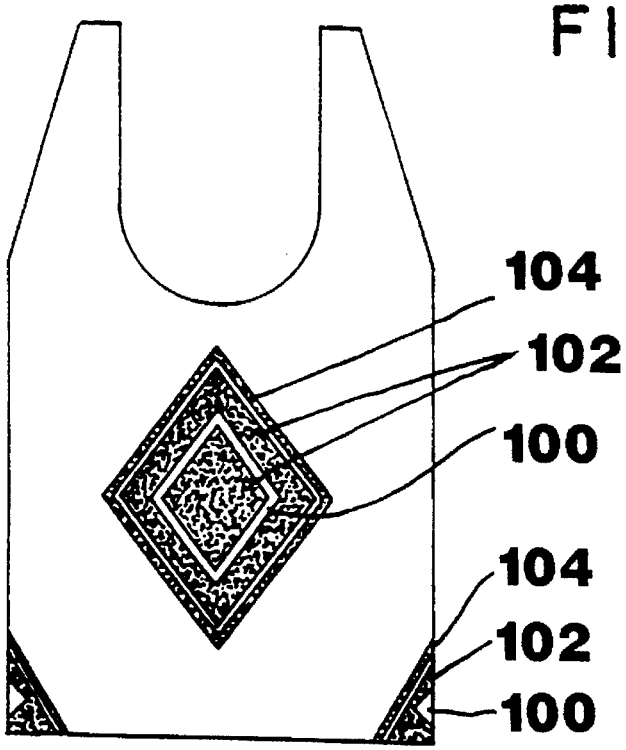
FIG. 4 is a front view of a cotton tank top.
Figure 5:
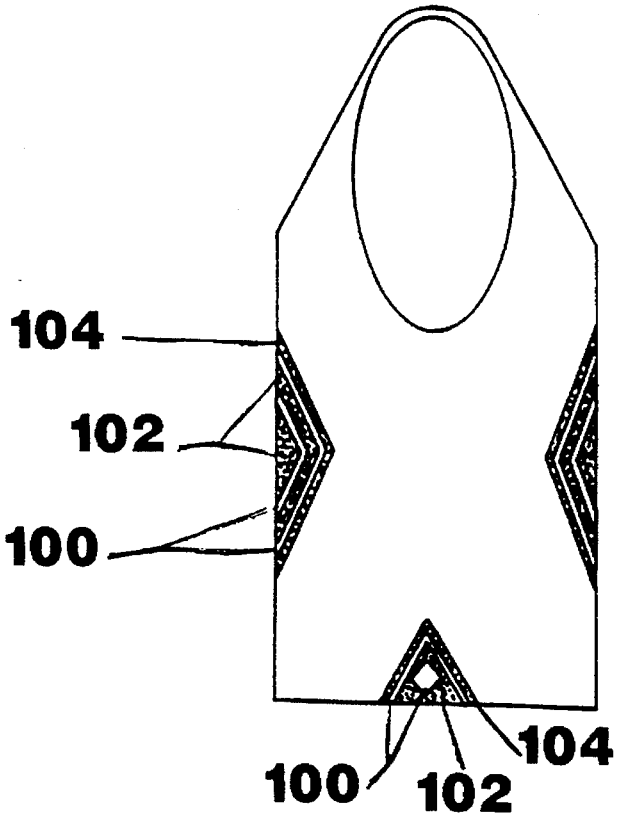
FIG. 5 depicts a side view of the cotton tank top of FIG. 4.
Figure 6:
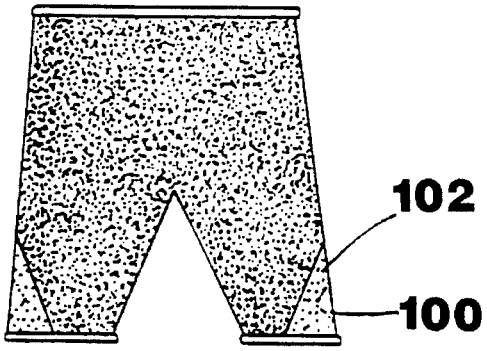
FIG. 6 illustrates a front view of a LYCRA short.
Figure 7:
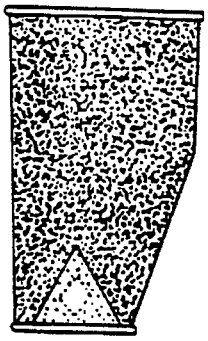
FIG. 7 depicts a side view of the LYCRA short of FIG. 6.
Figure 8:
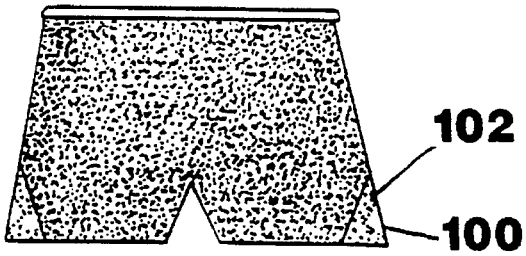
FIG. 8 is an front view of a SUPPLEX walking short.
Figure 9:
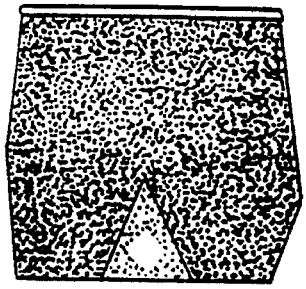
FIG. 9 illustrates a side view of the SUPPLEX walking short of FIG. 8.

In the area of high-visibility materials, the following terms are commonly employed.

High-visibility materials are defined as a material or device that, in an active (or primary lights-source) format, generates its own light to a brightness level that allows it to be seen easily. An item that generates its own light also is referred to as self-luminous. In a passive (or secondary light-source) format, high-visibility materials reflect light generated by an active source.

Reflectivity is defined as the degree to which a surface reflects light. Materials that naturally or by design reflect light in an efficient manner are those termed high-visibility; they absorb a lesser degree of the radiant energy that falls on it, and thus reflect a greater degree back.

There are three types of reflection: mirror reflection, such as that from a shiny, highly polished material; diffuse reflection, such as that from a rough material like cloth or fabric; and retroreflection, which occurs when a high percentage of radiant energy is returned back in the direction from which it came, and over a wide variety of angles from which the material is being struck.

There are two basic types of retroreflective materials: prismatic and spherical lens. Prismatic (or cube-corner) retroreflective materials use arrays of cube-corner reflective elements, each of which has three perpendicular planar surfaces. Spherical lens retroreflective materials use mirrored, spherical lens reflectors, typically made of glass beads.

Reflective materials can be incorporated into many formats, including iron-on films, pressure-sensitive films and sheeting, sew-on fabrics, inks and coatings, plastic-type reflectors and other variations such as piping, buttons, zippers, molded shapes, graphics and characters.

Retroreflective material has the property to reflect light directly back to the light source through a wide range of entrance angles. Such material usually reflects light from a vehicle's headlights directly back to the operator of the vehicle. Although a variety of retroreflective materials may be employed in the articles of the present invention, a preferred retroreflective material is SCOTCHLITE reflective material by 3M. This material is preferably employed in strips having a width of at least ⅜" to ¾" or in solid pieces of at least 6.5 square inches.

Fluorescent materials are materials which use pigments activated by ultraviolet and short wave-length visible light and which are used as high-visibility treatments for enhanced daytime contrast. Fluorescent materials are frequently red, orange, yellow or green. A common fallacy is that, because fluorescent materials are so vivid during the day, they will be equally beneficial at night. Though maximum effect of fluorescent materials is observed during twilight and overcast conditions, they are very inefficient and are not considered a "high-visibility" material when contacted by automobile headlights at night.

Moreover, the use of bright contrasting colors in the present invention enhances visibility during dawn through dusk hours.

Candle power is a term employed to describe the brightness of retroreflective materials. Though actual measuring methods vary and are complex, a reasonable, accurate representation of one candle power is a brightness level approximately 2.5 times greater than white cotton fabric. For example, a 125 candlepower materials at its optimum would return a light intensity 312.5 times brighter than a similar size piece of white shirt fabric (125×2.5=312.5). The 3M SCOTCHLITE employed in the present invention is rated at 500 candlepower, or about 1,250 times brighter than a similar sized piece of white cotton fabric.

Decision sight distance is a term used in traffic engineering that assumes a 2.5-second reaction time, followed by a deceleration of a vehicle under human operation. For example, a motorist traveling 55 m.p.h. on a wet, straight roadway will use approximately 1,000 feet to come to a stop after determining that he or she must stop to avoid an object identified as a pedestrian. Thus, when considering high-visibility materials for improved safety, it is preferred to use markings that are visible from at least 1,000 feet or more.

Angularity describes the ability of a material to act in a retroreflective manner when light is striking it at angles on either side of perpendicular. It is desirable to maintain a high degree of retroreflectivity at angles of 30 degrees or greater.

Observation angle is the angle created by the line of sight to the reflective materials and the line from the reflective material to the light source. When the light source is in-line—whether in front or behind the object—the observation angle is 0 degrees.

The diamond shape is a symbol often associated with safety or caution and has significance in the bicycling community as the designation for bike lanes in most major cities around the country. It is a symbol which is intended to elicit a response of caution when viewed by a motor vehicle operator.

In one embodiment of the present invention, the retroreflective material and the colored accent areas are presented in bold, contrasting colors. Such a presentation aids in visibility enhancement in dusk and other marginal light conditions where a motor vehicle may not yet have its lights on.

In a preferred embodiment of the present invention, the diamond-shaped retroreflective material within the colored accent area is positioned in strategic locations on the article of clothing.

For example, on a T shirt or tank top, the diamond-shaped retroreflective material encloses a first diamond-shaped colored accent area and which diamond-shaped retroreflective material is enclosed, in whole or in part, by a second diamond-shaped colored accent area and this composite design is placed in the middle of the chest and back on the front and back of the shirt, respectively.

Additionally, a diamond-shaped retroreflective material is enclosed, in whole or in part, by a colored accent area and a contrasting border, which is positioned on the sides or sleeves of the shirt. For a T shirt with long sleeves, this colored accent area is diamond-shaped. This design is positioned on the sleeves of the shirt. For a T shirt with short sleeves, the colored accent area is triangular. This design is positioned on the sleeves of the shirt. For a tank top with no sleeves, the colored accent area is triangular and the design is positioned on the sides of the shirt.

For a pant, a diamond-shaped retroreflective material is enclosed, in whole or in part, by a colored accent area and a contrasting border. The colored accent area is diamond-shaped. One or more of these composite designs is placed on both sides of the pant. For a short, a diamond-shaped retroreflective material is enclosed in a colored accent area. The colored accent area is triangular. This composite design is placed on both sides of the short.

The placement described above is designed to emphasize the human form, especially the human form in motion. Such a design is a feature of the present invention because early recognition of the human form has been demonstrated to be a factor in reducing or avoiding accidents between motor vehicles and individuals.

The purpose of the present invention is to permit an operator of a motor vehicle to see a person wearing the article of clothing of the present invention much earlier and much further away relative to a person not wearing an article of clothing of the present invention. Suitable articles of clothing to which is affixed the diamond-shaped retroreflective material enclosing a first colored accent area and which diamond-shaped retroreflective material is enclosed, in whole or in part, by a second colored accent area, includes long-sleeved T shirts, short-sleeved T shirts, tank tops, pants, shorts, sweat suits, sweat shirts, sweat pants, hats, socks, gloves, back packs, fanny packs, jackets, parkas. Particularly suitable clothing include activewear and most suitable are articles of clothing, which are worn for activities in which there is substantial risk of proximity to vehicles. These activities include cycling, walking, jogging, running, and in-line skating.

Obviously, numerous modifications and variations of the present invention are possible in light of the above teachings. It is therefore to be understood that within the scope of the appended claims, the invention may be practiced otherwise than as specifically described herein.

What is claimed is:

1. An article of clothing, comprising at least one diamond-shaped retroreflective material, which diamond-shaped retroreflective material either is solid or encloses a first colored accent area and which diamond-shaped retroreflective material is enclosed, in whole or in part, by a second colored accent area, in which said first colored accent area is diamond-shaped.

2. The article according to claim 1, wherein said second colored accent area is diamond-shaped.

3. The article according to claim 2, wherein said article of clothing comprises activewear clothing.

4. The article according to claim 3, in which said activewear clothing is a long-sleeved T shirt, comprising a front, back, and two sleeves, in which at least one diamond-shaped retroreflective material is positioned on the front, back, and each sleeve of the long-sleeved T shirt.

5. The article according to claim 3, in which said activewear clothing is a jacket, comprising a front, back, and two sleeves, in which at least one diamond-shaped retroreflective material is positioned on the front, back, and each sleeve of the jacket.

6. The article according to claim 3, in which said activewear clothing is a sweat suit, comprising a top and a bottom, which top comprises a front, back, and two sleeves and which bottom comprises two pant legs, in which at least one diamond-shaped retroreflective material is positioned on the front, back, each sleeve, and each pant leg of the sweat suit.

7. The article according to claim 3, in which said activewear clothing is a pant, comprising two pant legs, in which at least one diamond-shaped retroreflective material is positioned on each pant leg of the pant.

8. The article according to claim 3, in which said activewear clothing is a sock.

9. The article according to claim 3, in which said activewear clothing is a hat.

10. The article according to claim 3, in which said activewear clothing is a backpack.

11. The article according to claim 3, in which said activewear clothing is a glove.

12. The article according to claim 3, in which said activewear clothing is a fanny-pack.

13. The article according to claim 1, wherein said second colored accent area is triangular.

14. The article according to claim 13, wherein said article of clothing comprises activewear clothing.

15. The article according to claim 14, in which said activewear clothing is a short, comprising two pant legs, in which at least one diamond-shaped retroreflective material is positioned on each pant leg of the short.

16. An article of clothing, comprising at least one first diamond-shaped retroreflective material and at least one second diamond-shaped retroreflective material, which first diamond-shaped retroreflective material encloses a first colored accent area and which diamond-shaped retroreflective material is enclosed, in whole or in part, by a second colored accent area and which second diamond-shaped retroreflective material is enclosed, in whole or in part, by a third colored accent area, in which said first and second colored accent areas are diamond-shaped and said third colored accent area is triangular.

17. The article according to claim 16, wherein said article of clothing comprises activewear clothing.

18. The article according to claim 17, in which said activewear clothing is a short-sleeved T shirt, comprising a front, back, and two sleeves, in which at least one first diamond-shaped retroreflective material is positioned on the front and back of the short-sleeved T shirt and in which at least one second diamond-shaped retroreflective material is positioned on each sleeve of the short-sleeved T shirt.

19. The article according to claim 17, in which said activewear clothing is a tank shirt, comprising a front, back, and two sides, in which at least one first diamond-shaped retroreflective material is positioned on the front and back of the tank top and in which at least one second diamond-shaped retroreflective material is positioned on each side of the tank top.

* * * * *